US007747031B2

(12) United States Patent
Steinbuss

(10) Patent No.: US 7,747,031 B2
(45) Date of Patent: Jun. 29, 2010

(54) HEARING DEVICE AND METHOD FOR WIND NOISE SUPPRESSION

(75) Inventor: Andre Steinbuss, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1092 days.

(21) Appl. No.: 11/386,243

(22) Filed: Mar. 21, 2006

(65) Prior Publication Data

US 2006/0233407 A1 Oct. 19, 2006

(30) Foreign Application Priority Data

Mar. 21, 2005 (DE) ..... 10 2005 012 976

(51) Int. Cl.
*H04R 25/00* (2006.01)

(52) U.S. Cl. ..... 381/317; 381/312

(58) Field of Classification Search ..... 381/73.1, 381/317, 94.1, 94.2
See application file for complete search history.

(56) References Cited

U.S. PATENT DOCUMENTS 5,524,056 A * 6/1996 Killion et al. ..... 381/312
6,823,176 B2 11/2004 Rogers
7,181,030 B2 2/2007 Rasmussen et al.
2002/0037088 A1* 3/2002 Dickel et al. ..... 381/317
2002/0041696 A1 4/2002 Jensen
2003/0048910 A1 3/2003 Roy et al.
2004/0165736 A1 8/2004 Hetherington et al.

FOREIGN PATENT DOCUMENTS

DE 299 16 891 U1 3/2000
JP 6319193 A 11/1994

* cited by examiner

*Primary Examiner*—Brian Ensey
(74) *Attorney, Agent, or Firm*—Schiff Hardin LLP

(57) ABSTRACT

To reduce the disturbing effect of artifacts created by signal processing when reducing wind noises the microphone signal of a hearing device for the presence or the strength of a predefined wind noise signal and, if appropriate, the wind noise signal is released. A noise signal is generated that is emitted at the hearing aid output component in addition to the reduced wind noise signal. The noise signal is generated dependent on the wind noise signal, so that the wind noise signal is at least partly masked. The resultant signal is perceived by the wearer of the hearing aid to be less disturbing.

12 Claims, 1 Drawing Sheet

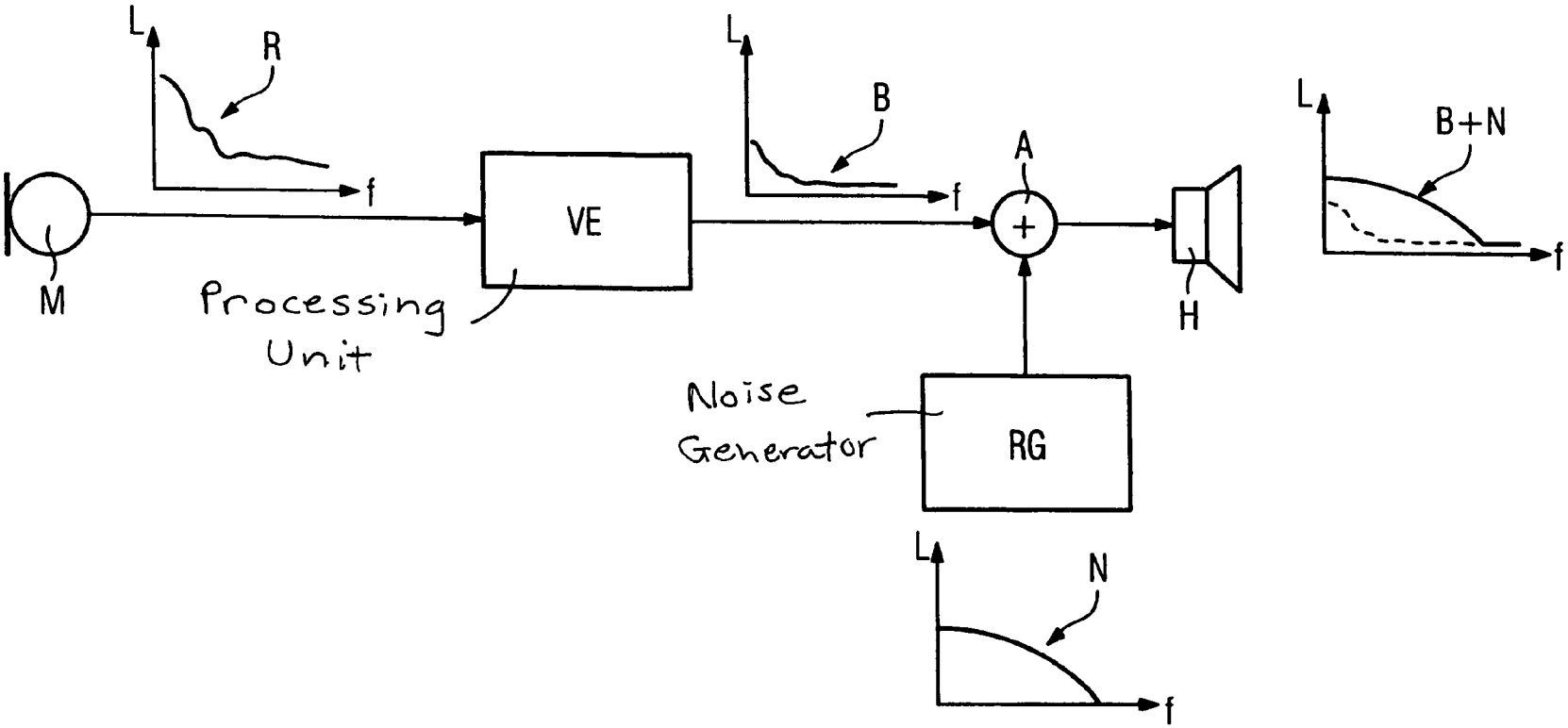
B+N
L
f
H
A
+
RG
N
L
f
B
L
f
Noise
Generator
VE
Processing
Unit
R
L
f
M

HEARING DEVICE AND METHOD FOR WIND NOISE SUPPRESSION

BACKGROUND OF THE INVENTION

1. Field of the Invention

The present invention relates to a hearing device, in particular a hearing aid, with a microphone device, which in the presence of wind produces a specific wind noise signal, and a speaker device. In addition, the present invention relates to a corresponding method for operating such a hearing device.

2. Description of the Prior Art

The microphones used in hearing aids to emit signals for subsequent signal processing are generally positioned at an exposed location, in order to ensure optimum sound pickup. This placement makes the microphones susceptible to wind noises, which are perceived by the wearer of the hearing aid as a disturbing, low-frequency rumbling and make communication drastically more difficult in this acoustic situation.

To counter this problem, one approach has been to try to obstruct the wind mechanically before it meets the microphone membrane. Commonly used for this purpose are so-called "jets" on the supporting crook of the hearing aid in the case of behind-the-ear hearing aids. The use of grills or filter elements, for example made of foam, over the inlet openings of the microphones to prevent turbulence of the air on the microphone membrane is possible both in the case of behind-the-ear hearing aids and in the case of in-the-ear hearing aids.

An alternative approval for reducing the low-frequency rumbling produced by wind is to digitally suppress the signal components arising from wind noises once they have been picked up by the microphone or microphones. It is customary for this purpose to switch over from multi-microphone operation to omni-operation and significantly lower the hearing aid amplification in the lower channels. Since the controls generally operate with very short time constants and significant levels of regulation, disturbances are audible even to those with impaired hearing. Rather, the sound quality and speech intelligibility suffer greatly, while the wind noises generally remain audible at a reduced level.

A wind-noise reduction method is known for example from DE 100 45 197 C1. This known method involves an analysis of the output signals of at least two microphones of a hearing aid or a hearing aid system for detecting wind noises. If wind noises are present, a signal processing unit of the hearing aid or the hearing aid system and/or the signal paths of the microphones are appropriately adapted to reduce them. This may take place, for example, by switching over from directional operation to omnidirectional operation, by filtering, adapting the control times, switching off the microphones or reducing or closing the sound inlets.

German Utility Model DE 299 16 891 U1 describes a tinnitus masking device and hearing aid which can be worn in the concha of the ear. In the case of this tinnitus masking device or hearing aid, noises inside the ear are masked by the signal of a noise generator.

SUMMARY OF THE INVENTION

An object of the present invention is to increase the hearing comfort of a hearing device, specifically in the presence of wind.

This object is achieved according to the invention by a hearing device with a microphone device, which in wind produces a specific wind noise signal, and a speaker device, and an analysis device that analyzes a microphone signal for the presence or the strength of the wind noise signal and a noise generator that produces a noise signal to emit via the speaker device dependent on the wind noise signal, so that the wind noise signal is at least partly masked.

In addition, the invention provides a method for operating a hearing device, in particular a hearing aid, include, the steps of picking up a microphone signal, analyzing the microphone signal for the presence or the strength of a predefined wind noise signal and generating a noise signal in dependence on the wind noise signal, so that the wind noise signal is at least partly masked.

Since wind noises are also entirely audible to those with normal hearing, but occur in the form of a soft noise and not, as in a hearing aid, as a low-frequency rumbling, the basis of the invention is to produce the known wind noise artificially for the wearer of a hearing aid, in order to give the wearer a natural hearing sensation, and to use the characteristic of this soft noise signal for masking artifacts that occur. An artificial signal is consequently produced in addition to the (possibly) already pre-filtered usable signal and its psychoacoustic perception is exploited to mask artifacts and residual effects of the wind noise created by signal generating technology.

The noise generator preferably takes the form of a digital sound generator. This makes it possible to produce any noise signals desired, resembling the noise of natural wind very closely.

The noise generator alternatively may be formed by a microphone that is already present in the hearing aid or an A/D converter that is already present. This allows the number of components fitted in hearing aids not to be increased.

It is particularly advantageous if the hearing device according to the invention has a damping device for damping the specific wind noise signal, so that the noise generator produces the noise signal dependent on the damped wind noise signal. As a result, the wind noise is initially reduced by mechanical technology as far as possible, and is subsequently masked with noise.

This damping device may have, for example, an adaptive filter. Consequently, the device-specific wind noises, as well as wind noise components produced by the individually specific wearing of the hearing device by the user, can be suppressed as far as possible in a targeted manner.

The microphone device may have a number of microphones that can be switched from directional operation to omni-directional operation or vice versa, dependent at the wind noise signal. In this way, the number of wind noise sources at the input side can be reduced.

In the case of a special configuration of the damping device described above, in the presence of a wind noise signal lower channels for lower frequencies can be automatically damped or reduced. Consequently, the wind noises have a less disturbing effect and the masking of the residual wind noise can be achieved by a noise of a lower level.

DESCRIPTION OF THE DRAWINGS

The single FIGURE is a block diagram showing the basic components of a hearing aid according to the invention.

DESCRIPTION OF THE PREFERRED EMBODIMENTS

A microphone M of a hearing aid, schematically represented in the FIGURE, is exposed to wind, so that turbulence acting on the microphone membrane leads to "rumbling" R. This rumbling R is distinguished by the fact that it has high amplitude components in the low-frequency range.

The output signal of the microphone M is fed to a processing unit VE, which is capable of damping the rumbling R, i.e. the wind noise created by signal technology. This is accomplished for example by reducing the amplification in the low-frequency range. In addition, the processing unit may also change the microphone mode, for example from directional operation to omnidirectional operation, so that the noise components are reduced.

The wind noise damped by signal technology at the output of the processing unit VE can be heard at the earphone H of the hearing aid as a hum H. As the FIGURE shows, the level L of the hum H lies below the level L of the rumbling R, so that the hum H has a less disturbing effect than the rumbling R. Nevertheless, the hum H does cause a residual disturbance.

Since the hum H is an unnatural noise, an adder A is used to add noise N to the hum H. The noise N is produced by a noise generator RG. This means that, in addition to changing the microphone mode and reducing the amplification in the low-frequency range, a technically produced, quiet noise signal is mixed with the existing usable signal in order to mask the audible artifacts and leftover remains of the wind noise caused by the algorithms. The wearer of the hearing aid therefore primarily perceives the artificially produced noise, since the hum H is masked by the noise N. The artificial noise N is found to be less disturbing, since it corresponds more to the natural perception of wind than the hum H.

Digital sources such as sound generators on the hearing aid chip and noise sources at the input of the hearing aid (microphones, A/D converters) are suitable as such noise sources. The latter could be used as a noise source, for example, whenever the parameterization of the microphone noise suppression can be changed by an adaptive filter, for example a modified "Wind Noise Canceller".

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing device comprising:

a microphone device that detects an incoming audio signal containing wind noise, said microphone device producing an electrical microphone signal having a wind noise component;

a speaker that emits an acoustic output corresponding to said microphone signal;

an analysis device supplied with said microphone signal that automatically analyzes said microphone signal to detect a characteristic of said wind noise component selected from the group consisting of a presence of said wind noise component and a strength of said wind noise component; and a noise generator connected between said analysis device and said speaker device that generates an electrical noise signal, dependent on the characteristic of said noise component detected by said analysis device, and said noise generator supplying said electrical noise signal to said speaker device and said speaker device emitting an additional acoustical noise output, together with said acoustical output, said additional acoustical noise output at least partly masking a content of said acoustic output corresponding said wind noise component.

2. A hearing device as claimed in claim 1 wherein said noise generator is a digital sound generator.

3. A hearing device as claimed in claim 1 wherein said noise generator comprises at least one of a microphone and an analog-to-digital converter.

4. A hearing device as claimed in claim 1 comprising a damping device that damps said wind noise component, and said analysis device detecting said characteristic as a characteristic of said damped wind noise component, and said noise signal generator generating said electrical noise signal dependent on said characteristic of said damped wind noise component.

5. A hearing device as claimed in claim 4 wherein said damping device comprises an adaptive filter.

6. A hearing device as claimed in claim 1 wherein said microphone device comprises a plurality of microphones, and a switching arrangement that switches said plurality of microphones from a directional mode of operation to an omnidirectional mode of operation dependent on said wind noise component.

7. A hearing device as claimed in claim 1 comprising a plurality of channels at respective frequencies between said microphone device and said speaker device, and comprising a damping device that, if said wind noise component is present, reduces channels for lower frequencies among said plurality of channels.

8. A hearing device as claimed in claim 1 comprising a housing, adapted to be worn at an ear of a hearing-impaired person, containing said microphone device, said speaker device, said analysis device and said noise generator.

9. A method for operating a hearing device comprising the steps of:

picking up an audio signal and converting said audio signal into an electrical microphone signal;

automatically electronically analyzing said microphone signal to detect a characteristic of a wind noise component in said microphone signal selected from the group consisting of a presence of said wind noise component and a strength of said wind noise component;

automatically generating an electronic noise signal, dependent on said characteristic; and acoustically emitting an acoustic output corresponding to said microphone signal and an additional acoustic output corresponding to said electronic noise signal, said additional acoustic output at least partly masking a content of said acoustic output corresponding to said wind noise component.

10. A method as claimed in claim 9 comprising damping said wind noise component by electronic signal processing.

11. A method as claimed in claim 9 comprising picking up said audio signal with a plurality of microphones, and automatically switching said plurality of microphones between a directional mode of operation and an omni-directional mode of operation dependent on said characteristic.

12. A method as claimed in claim 9 comprising damping said wind noise component by electronic signal processing before analyzing said microphone signal for said characteristic.

* * * * *